367-93 $$$ SR
E245K XR 3,942,601 2/63 W X 20,37C (2)

United States 1] 3,942,601
Smith 5] Mar. 9, 1976

[54] REFUSE COLLECTION APPARATUS WITH PERSONNEL PROTECTION MEANS

[75] Inventor: Fred T. Smith, Palos Verdes Peninsula, Calif.

[73] Assignee: Sargent Industries, Inc., Los Angeles, Calif.

[22] Filed: Apr. 18, 1974

[21] Appl. No.: 461,920

[52] U.S. Cl. ..... 180/82 R; 340/267 R
[51] Int. Cl.[2] ..... B60K 28/00
[58] Field of Search ..... 180/82, 99, 103, 111, 112, 180/113; 214/83.3; 340/258 B, 267 R, 52 R, 279; 317/DIG. 2

[56] References Cited

UNITED STATES PATENTS

| | | | |
|---|---|---|---|
| 3,138,357 | 6/1964 | Whitwell et al. | 340/258 B |
| 3,231,880 | 1/1966 | Stein | 180/82 R X |
| 3,235,738 | 2/1966 | Kress et al. | 340/258 B |
| 3,503,531 | 3/1970 | Barbieri | 214/83.3 |
| 3,732,555 | 5/1973 | Strenglein | 340/258 B |

*Primary Examiner*—Kenneth H. Betts
*Assistant Examiner*—R. Schrecengost
*Attorney, Agent, or Firm*—Ellsworth R. Roston

[57] ABSTRACT

A vehicle having a particular area in proximity thereto which is dangerous to personnel when the vehicle is performing a particular function is combined with a personnel detection means mounted on the vehicle and having characteristics for providing an electrical output signal in response to the presence of a person in the particular area. Apparatus associated with the particular function is mounted on the vehicle and responsive to the output signal of the personnel detection means to inhibit the particular function and reduce the danger to the person in the particular area.

21 Claims, 11 Drawing Figures

3942601

REFUSE COLLECTION APPARATUS WITH PERSONNEL PROTECTION MEANS

BACKGROUND OF THE INVENTION

1. Field of the Invention

This invention relates generally to refuse collection vehicles and more specifically to means for detecting the presence of personnel in proximity to dangerous loading apparatus associated with the vehicles.

2. Description of the Prior Art

Refuse collection vehicles have been provided with various designs to accommodate the unloading of individual refuse containers into the vehicle by refuse collection personnel. Generally, the vehicles have been provided with a small hopper into which the personnel have initially loaded the refuse. When the hopper has become full, loading apparatus has been actuated to move the refuse from the hopper into a large storage body.

In a first type of vehicle, hydraulically actuated packing panels have scooped the refuse from the hopper and packed it into the storage body in a manner such as that disclosed and claimed in my copending application Ser. No. 264,021, now U.S. Pat. No. 3,899,091, assigned of record to the assignee of record of the present application. In this type of apparatus the hopper, which is typically provided at the rear of the vehicle, is partially defined by a loading lip over which the individual containers are emptied by the personnel. From a normally tucked position above the hopper, a hydraulically actuated packing panel moves so that a narrowed edge thereof passes in close proximity to the loading lip. This type of loading operation is particularly desirable since the packing panel and the loading lip function as a pair of jaws as they move into relative proximity with each other. This movement can be of advantage in chopping large objects into a more convenient size; however, it can also be particularly dangerous to personnel. Anyone having an arm or leg extending over the loading lip could be severly injured during the loading operation.

To compound the danger, this loading operation is performed in closest proximity to the area around which the personnel normally operate. Furthermore, refuse which has not been fully loaded into the hopper often extends over the loading lip, and there is some tendency for the personnel to push this refuse into the path of the packing panel. This, of course, increases the probability of injury.

In a second type of vehicle, the hopper is typically supported by a pair of arms in a normal position at the front of the vehicle. The arms are pivotally mounted to the vehicle to raise and overturn the hopper so that its contents empty into the storage body. This type of loading apparatus is particularly dangerous to anyone who might have moved into the normal position of the hopper. Such a person could be struck and severly injured by the hopper during the loading operation.

In both of these types of vehicles, the loading apparatus generally includes an electrical circuit for selectively energizing a motor which in turn rotates a pump to provide a source of pressurized fluid. This fluid is typically used to operate the hydraulic cylinders associated with the packing panel in the first type of vehicle and the loading arms in the second type of vehicle.

To reduce the obvious danger to personnel, the electrical circuits in these types of loading apparatus have been provided with a plurality of switches, biased in a normally open position, which have had to be simultaneously closed to perform the loading operation. The switches have been mounted at positions spaced from the dangerous area and have been widely separated so that they have not been simultaneously actuable by a single person. This system has worked well where the number of loading personnel has equaled the number of switches. However, where the number of personnel has exceeded the number of switches, the excess personnel have been free to move into the dangerous area. Where the number of loading personnel has been less than the number of switches, the driver of the vehicle has typically had to participate in the loading operation.

SUMMARY OF THE INVENTION

The present invention substantially reduces the danger to personnel in proximity to the hopper whether they be loading personnel, driving personnel, or curious children viewing the loading operation. For example, in accordance with the present invention, means can be mounted on the vehicle for detecting personnel in proximity to the hopper and for producing a particular output signal in response to the detection. This output signal can be used to inhibit the loading operation until the dangerous area is clear. In one embodiment the electrical signal inhibits the operation of the motor in the loading apparatus so that the loading apparatus is inhibited from moving. In another embodiment, the electrical signal causes a hydraulic valve to close so that fluid cannot be pumped to the hydraulic cylinders. This also inhibits the loading operation.

In either the first or second types of vehicles, the personnel detection apparatus can include a source providing a detection signal, such as a beam of light, and a signal detector, such as a photoelectrical cell. The signal source and detector will typically be disposed so that a person moving into the dangerous area will inhibit the light beam so that the photoelectric cell develops the particular output signal.

In such a detection apparatus, there may be signal source and detector for each of a plurality of light beams which define a detection plane. Alternatively, a signal source and detector may provide a single light beam which is repeatedly reflected across the dangerous area. In various embodiments, the reflected light beam may intersect itself and the source and detector may be disposed on the same side of the dangerous are to simplify the detection apparatus.

In a further embodiment of the personnel detection apparatus, the signal source provides sound waves of a particular carrier frequency. A person present in the dangerous area modulates the carrier frequency to provide a doppler shift frequency which is detected by a detector to provide the particular electrical signal.

The detection apparatus can also include a probe disposed in proximity to the dangerous area and having a capacitance which increases when a person moves into the area. This capacitance can be included in a tank circuit which detunes in response to the increased capacitance. This detuning can be sensed by an electronic switch to inhibit operation of the loading apparatus.

These and other features of the present invention will become more apparent with a detailed description of the preferred embodiments illustrated in the associated drawings.

DESCRIPTION OF PREFERRED EMBODIMENTS

Figures 1, 2:
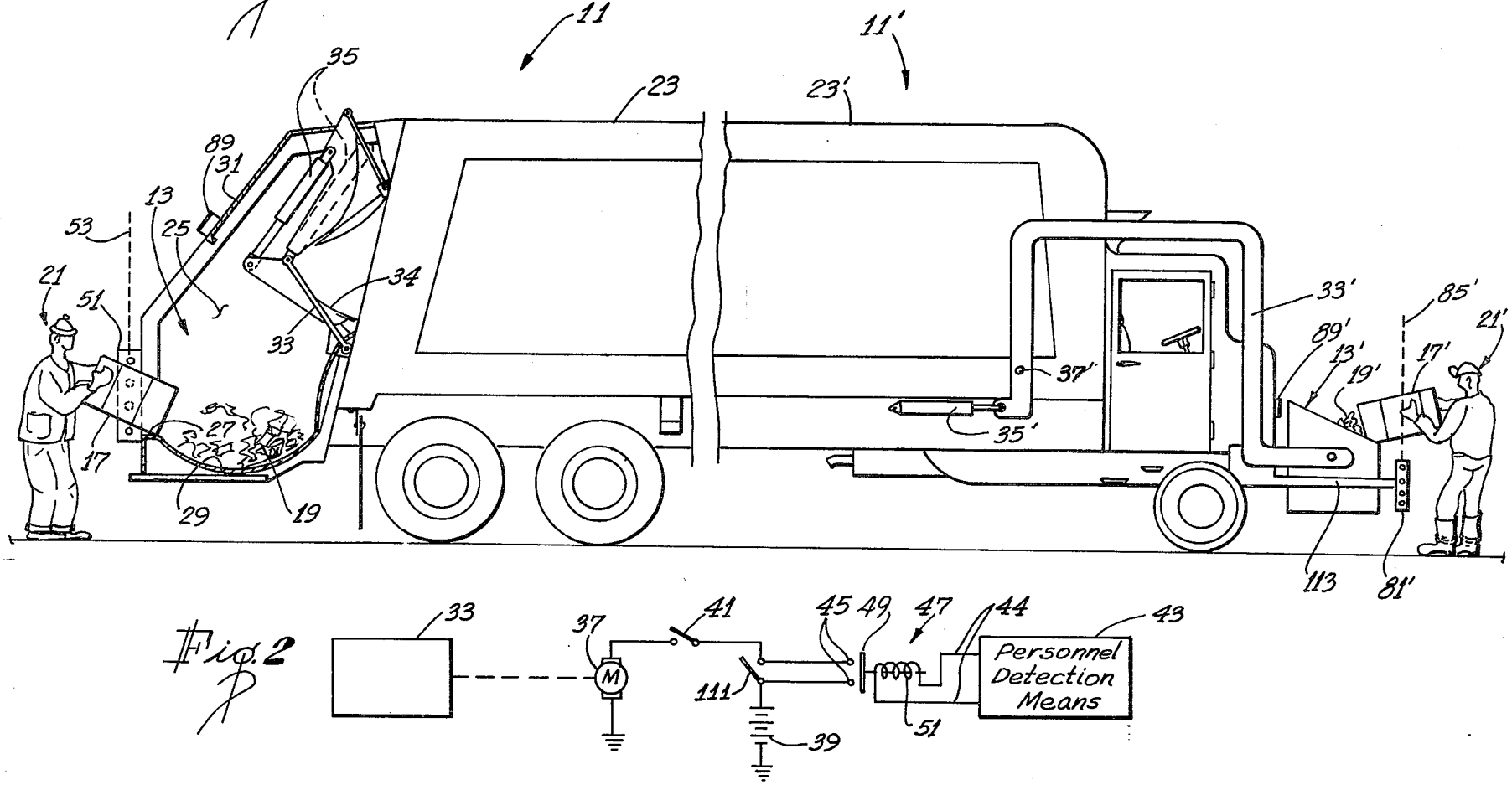
FIG. 1 is a fragmentary side elevational view of first and second types of refuse collection vehicles.
FIG. 2 is a schematic diagram of one embodiment of a loading apparatus and personnel detection means of the present invention.

A vehicle is illustrated generally in FIG. 1 and designated by the reference numeral 11. The vehicle 11 is of the type which performs a particular function which renders a particular area in proximity to the vehicle 11 dangerous to personnel. For example, the vehicle 11 can be a refuse collection vehicle, such as those commonly used to collect refuse in residential areas. As illustrated in FIG. 1, the refuse collection vehicles 11 can be either of a first type of vehicle having a stationery hopper, or a second type of vehicle having a movable hopper. Although the discussion will proceed generally with reference to the first type of vehicle, elements performing a similar function in the second type of vehicle will be referred to with the same numerals followed by a prime designation. For example, the hoppers will be designated generally by the reference numerals 13 and 13′ for the respective vehicles 11 and 11′ of FIG. 1.

In a typical operation of a refuse collection vehicle 11, individual containers 17 of refuse 19 are emptied into the hopper 13 by refuse collection personnel. The reference numeral 21, which is applied to such a person in FIG. 1, will be used generally herein to refer to any person who might be in proximity to the hopepr 13. In such a vehicle 11, the particular function that is dangerous to the person 21 is that associated with the loading operation wherein the refuse 19 is displaced from the hopper 13 into a storage body 23.

In the first type of vehicle 11, the hopper 13 is defined by a pair of side panels 25, a curved bottom 29, and a loading lip 27, which extends between the side panels 25. A cover member 31 typically extends at least partially over the hopper 13. In this first type of vehicle 11, the loading operation is typically performed by a loading apparatus which may include a packing panel 33 having a narrow edge 34. As shown in FIG. 2, the packing panel 33 is normally controlled by an electrical circuit including a battery 39 and a switch 41 for selectively operating a motor 37. Generally, the motor 37 actuates a hydraulic system including at least one hydraulic cylinder 35.

Figure 3:
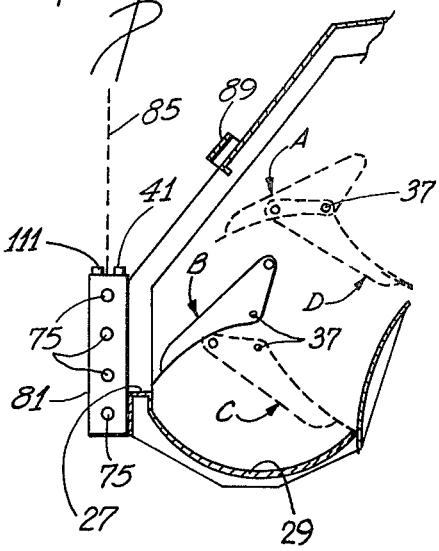
FIG. 3 is a side elevational view of the hopper of the first type of vehicle shown in FIG. 1.

Although the packing panel 33 is illustrated in a normally tucked position in FIG. 1, it is movable by the cylinders 35 through an infinite number of positions, some of which are progressively designated by the letters A, B, C, and D in FIG. 3. From the tucked position D, the packing panel 33 rotates about a point 37 to the position A where the narrowed edge 34 extends rearwardly of the vehicle 11. From the position A, the point 37 is moved downwardly and rearwardly so that the narrowed edge 34 passes in close proximity to the loading lip 27. The panel 33 is then pivoted about the point 37 so that the loading lip passes along the bottom 29 of the hopper 13. Finally, the panel 33 is moved upwardly to the tucked position D.

The position B is illustrated as a solid line to emphasize its importance to the present invention. As noted, when the packing panel 33 is in the position B, it passes in close proximity to the loading lip 27 in a manner similar to a pair of jaws. It is apparent that any person 21 having a portion of his body extending over the loading lip 27 can be severely injured during the loading operation.

It is a primary purpose of the present invention to inhibit operation of the packing panel 33 while anyone is within the particularly dangerous area in proximity to the loading lip 27. Therefore, the preferred embodiments of the invention include personnel detection means 43 having characteristics for providing an electrical output signal on a pair of conductors 44 in response to the presence of the person 21 in the particular area. The electrical circuit including the battery 39, the switch 41, and the motor 37, can be interrupted and connected to a pair of contacts 45 of a relay shown generally at 47. The relay 47 typcially includes a plunger 49 which is normally biased to short circuit the contacts 45. A solenoid 51, which is generally connected to the conductors 44, can be responsive to the output signal of the personnel detection means 43 to withdraw the plunger 49 from the contacts 45.

It will be appreciated that in another embodiment of the invention the relay 47 might be normally biased to the open position but held in a normally closed position by the solenoid 51 which is normally energized. In such an embodiment, the electrical output signal provided by the personnel detection means 43 can be a current on the conductors 44 having a magnitude sufficiently reduced so that the plunger 49 moves to its normally biased position to open the contacts 45. Of course, the electrical signal in such an embodiment may be a complete absence of current on the conductors 44.

Figure 4:
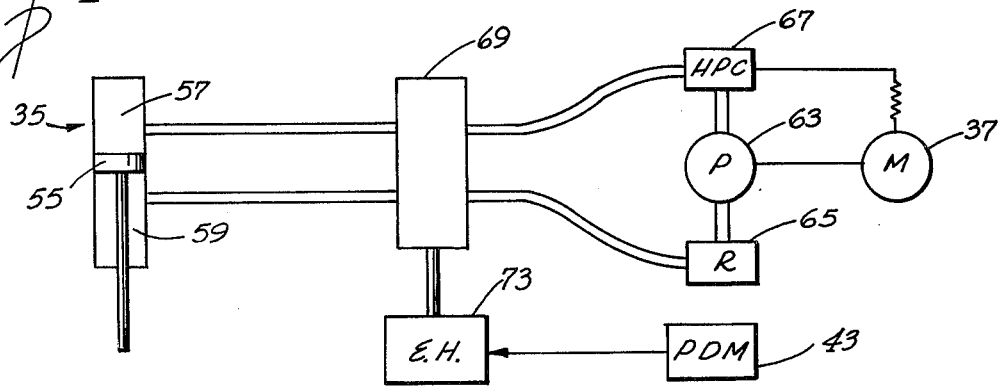
FIG. 4 is a schematic diagram of a further embodiment of the loading apparatus and personnel detection means of the present invention.

The electrical signal provided by the personnel detection means 43 can be used to inhibit the operation of other portions of the loading apparatus. For example, as illustrated in FIG. 4, the loading apparatus may comprise the cylinder 35 having a movable partition 55 therein which partially defines first and second cavities 57 and 59, respectively. In such an embodiment, a hydraulic system for actuating the cylinder 35 may include a pump 63 for pumping a fluid from a reservior 65 into a high-pressure container 67. The motor 37 is responsive to a relatively low pressure in the container 67 to drive the pump 63. In this manner, the pressure of the fluid in the container 67 is maintained at a substantially high constant pressure. A valve 69 communicates on its input side with the reservoir 65 and the container 67. The output side of the valve 69 communicates with the first and second cavities 57 and 59, respectively, of the cylinder 35.

The valve 69 can include a gate movable at least between first and second positions to introduce the high-pressure fluid in the container 67 to one of the first or second cavities 57 and 59, respectively. The fluid in the other of the cavities 57 and 59 is gated through the valve 69 into the reservoir 65. If the high-pressure fluid is introduced into the first cavities 57, the piston 55 moves downwardly; conversely, if the high-pressure fluid is introduced into the second cavity 59, the piston 55 moves upwardly. It follows that the position of the gate in the valve 69 determines generally whether the loading apparatus is moving in a forward or reverse direction.

The position of the gate in the valve 69 can be made responsive to an electrohydraulic mechanism 73 which in turn can be responsive to the output signal on the conductors 44 of the personnel detection means 43. For example, in response to the output signal, the electrohydraulic mechanism 73 may move the gate in the valve 69 so that the high-pressure fluid is introduced into the cavity 59. This could cause the piston 55 to move upwardly so that the loading apparatus moves in a reversed direction. It might also be desirable to provide the gate in the valve 69 with a third position inhibiting the flow of the high-pressure fluid to both of the first and second cavities 57 and 59, respectively. In such an embodiment, the output signal could cause the electrohydraulic mechanism 73 to move the gate to the third position so that movement of the loading apparatus would be inhibited in both the forward and reverse directions.

The personnel detection means 43 can be of the general type including transmission means for sending a detection signal relative to the particular area and receiving means positioned relative to the transmission means to receive the detection signal. In this type of detection means 43, particular characteristics which are exhibited by the detection signal when a person is in the particular area can be detected by the receiving means to provide the output signal. Such a detection means 43 is the photoelectric system illustrated in FIG. 5 to include at least one light source 75 providing at least one beam of light 77. A light detector 79, which typically includes a photoelectric cell, is generally disposed along the path of each of the beams of light 77. It is desirable that the light source 75 be disposed with respect to the detectors 79 so that the beams of light 77 extend across the particular area. The detectors 79 are generally connected to the conductors 44 to provide the electrical output signal.

In a preferred embodiment the light source 75 is supported in a first housing 81 which can be mounted to extend from one of the side panels 25 rearwardly of the loading lip 27. An associated detector 79 can be supported in a second housing 83 which can be mounted in a similar manner to extend from the other side panel 25. In this manner, the beam of light 77 extends rearwardly of the loading lip 27 and across the vehicle 11.

It may be desirable to provide more than one of the beams of light 77 in order to define a particular plane across the dangerous area. In such an embodiment, the detectors 79 would typically be connected in parallel so that an object blocking any one of the beams of light 77 would inhibit the packing operation. The particular plane can be that illustrated by the substantially vertical dotted line 85 illustrated in FIG. 3.

In one embodiment, the plane 85 is defined by a plurality of the light sources 75, and a plurality of associated detectors 79 having a plurality of associated beams of light 77 extending therebetween. In such an embodiment, it may be desirable that all of the light sources 75 are disposed in the housing 81 and all of the detectors 79 are disposed in the housing 83. This could simplify the wiring of the photoelectric system.

Figure 6:
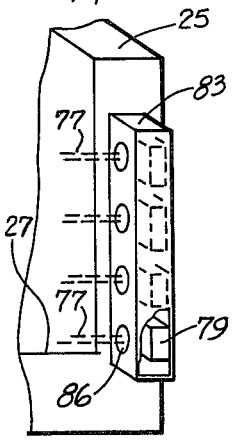
FIG. 6 is a perspective view of one of the housings shown in FIG. 5.
Figure 7:
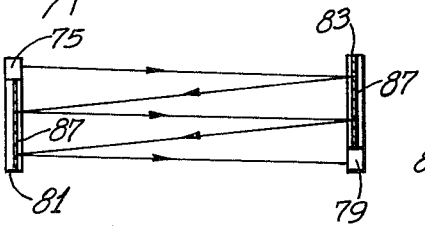
FIG. 7 is a rear elevational view of the vehicle showing an additional embodiment of a photoelectric personnel detection means of the present invention.

It is well known that much of the refuse 19 includes opaque fluids which can splash in proximity to the hopper 13. Therefore, it may be desirable to construct the housings 81 and 83 in a manner which will prevent the fluids from splashing on the light sources 75 or the detectors 79 to block the beams of light 77. Thus, it may be desirable to form the housings 81 and 83 as illustrated in FIG. 6 so that a plurality of holes 86 are defined along one side thereof. The light sources 75 and detectors 79 can then be mounted within the respective housings 81 and 83 in spaced relationship to the holes 86. In such an embodiment, the associated beam of light 77 passes through an associated one of the holes 86. The holes 86 can be made sufficiently small to inhibit the splashing of the refuse 19 into the housing 83 and sufficiently large to prevent the refuse from collecting on the housing 83 to block one of the holes 86.

In a further embodiment of the invention, the photoelectric system can include one of the light sources 75 and one of the detectors 79. In such an embodiment the plane 85 may be defined by a detection signal which is repeatedly reflected across the particular area by reflection means mounted in the housings 81 and 83. In this manner, a single light source 75 and detector 79 can provide a plurality of the beams of light 77 each extending across the particular area. In such an embodiment, the reflection means can comprise mirrors 87, and the light source 75 and detector 79 can be disposed in the most widely spaced portions of the respective housings 81 and 83. For example, the light source 75 can be disposed in the top of the housing 81 and the detector 79 can be disposed in the bottom of the housing 83 to provide for nonintersecting beams of light 77.

Figure 8:
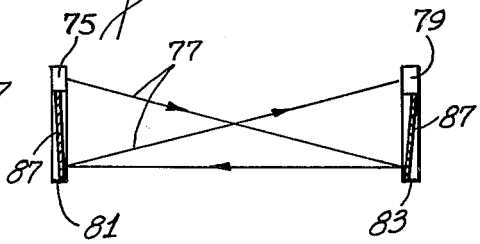
FIG. 8 is a rear elevational view of the vehicle showing a further embodiment of a photoelectric personnel detection means of the present invention.

In a further embodiment of the invention, the beams of light 77 are reflected by the mirrors 87 so that they intersect in the plane 85. In such an embodiment the light source 75 and the detector 79 may be disposed in the most proximate portions, e.g., the top portions of the respective housings 81 and 83, as shown in FIG. 8.

Figure 9:
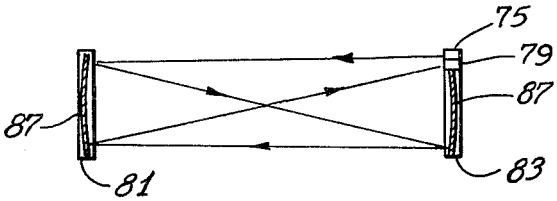
FIG. 9 is a rear elevational view of the vehicle showing still a further embodiment of the photoelectric personnel detection means of the present invention.

In still a further embodiment of the invention, the light source 75 and the detector 79 can be disposed in the same housing 83 to simplify the wiring of the detection means 43. As illustrated in FIG. 9, such an embodiment will typically include at least one of the mirrors 87 disposed in each of the housings 81 and 83.

In each of the foregoing embodiments, the holes 86 can be appropriately configured and spaced along the housings 81 and 83 so that the beams of light 77 extend through the holes 86.

Although the photoelectric system may be particularly desirable for providing the electrical output signal, the invention includes other types of personnel detection means 43. For example, a proximity responsive system can be adapted to inhibit the loading operation of the vehicle 11. Such a system might include a capacitive probe or antenna 89 connected in series with a resistance 91 to form a resistance shunt across a tank circuit 92 including an inductance 95 and a capacitance 93.

Figure 5:
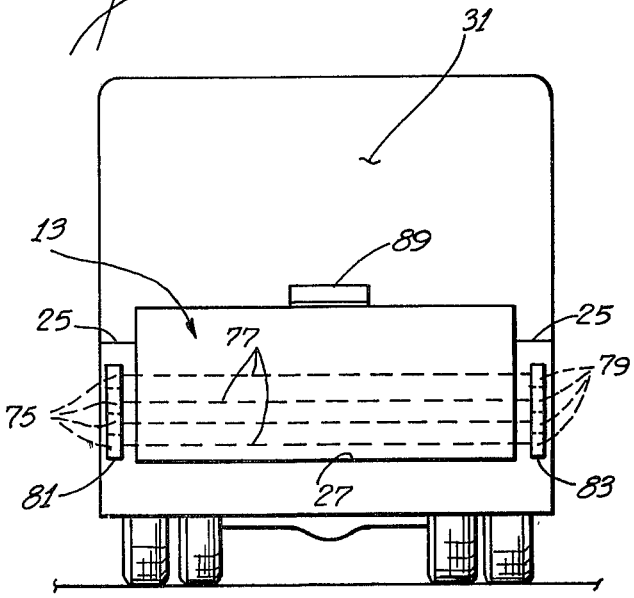
FIG. 5 is a rear elevational view of the first type of vehicle illustrated in FIG. 1, which shows a preferred location for housings of a photoelectric personnel detection means.

The Q of the tank circuit 92, which is usually expressed as the ratio of the inductive reactance at resonance to the resistance, determines the output amplitude of an oscillator 97. A decrease in this output amplitude can be sensed by an electronic switch 99 to provide the electrical output signal of the detection means 43. When the person 21 moves into proximity with the antenna 89, the capacitance thereof increases so that the capacitive reactance of the resistance shunt also increases. This decreases the impedance of the shunt so that the Q of the tank circuit is also decreased. This in turn causes the output amplitude of the oscillator 97 to be decreased so that the electronic switch 99 provides the electronic output signal. In a preferred embodiment of the invention, the probe or antenna 89 is mounted on the cover 31 substantially as shown in FIGS. 3 and 5. The antenna 89 may also be mounted on the side panels 25 or in any other area in proximity to the loading lip 27.

Figure 11:
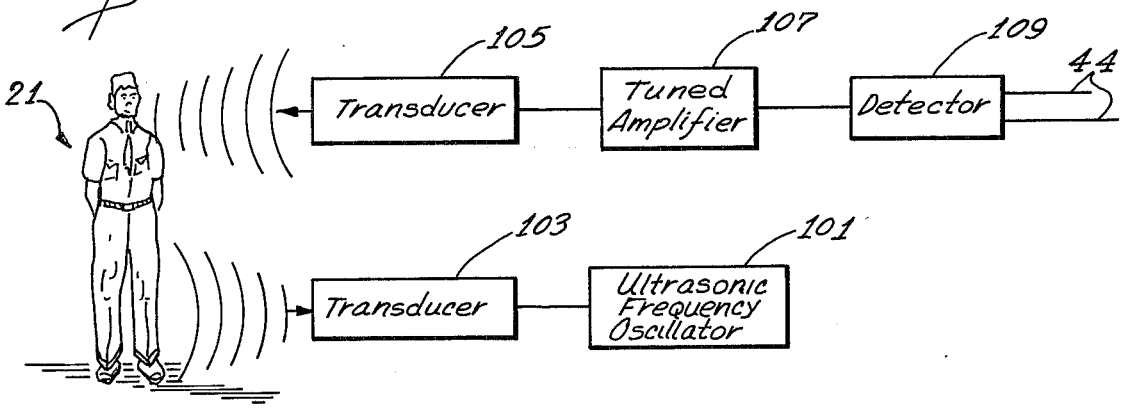
FIG. 11 is a schematic diagram of still a further embodiment of the personnel detection means of the present invention.

The personnel detection means 43 can also be of the type which senses the ordinary movement of persons in a particular area. As illustrated in FIG. 11 herein, the device can include an oscillator 101 providing an intermediate signal having an ultrasonic frequency. In response to the intermediate signal, a sending transducer 103 radiates substantially constant frequency ultrasonic sound waves across the particular area. A receiving transducer 105 is preferably disposed on the side of the particular area opposite the sending transducer 103 to receive the ultrasonic sound waves. These sound waves can then be amplified in a tuned amplifier 107 and detected in a detector 109.

It is of particular interest that any movement of a person within the particularly dangerous area produces a doppler shift frequency which modulates the carrier after it is transmitted by the transducer 103. This modulation of the carrier is sensed in the detector 109 which provides the particular electrical output signal in response to the modulation. In such an embodiment, the transducers 103 and 105 can be advantageously mounted to the vehicle 11 in positions similar to those of the housings 81 and 83 or in any other positions on generally opposite sides of the particular area.

As discussed in my copending application Serial No. 264,021, the movement of the packing panel 33 into relative proximity with the loading lip 27 can be advantageously relied upon to chop large objects of the refuse 19 which extend over the loading lip 27. In some cases, these large objects may extend sufficiently over the loading lip 27 to interrupt the detection signal, such as the beam of light 77. This, of course, would inhibit the operation of the loading apparatus so that the advantageous chopping function could not be performed. To accommodate such a desirable function, the invention can be provided with an override switching means 111 which can be operated to short the contacts 45. The switching means 111, which is shown schematically in FIG. 2, can be mounted on the housing 81 or in some other position preferably in proximity to the switch 41. It may be desirable that this switching means 111 include more than one switch interconnected in series across the contacts 45 and mounted on the vehicle 11 in spaced relationship so that more than one of the collection personnel 21 can participate in overriding the safety features of the present invention.

Any of these personnel detection means 43 and associated loading apparatus can be used to inhibit the loading operation associated with the second type of refuse collection vehicle 11'. Such a vehicle 11' generally includes a movable hopper 13' supported by a pair of arms 33' pivotally mounted on a pin 37'. A plurality of hydraulic cylinders 35' typically engage the arms 33' at a point spaced from the pin 37' to pivot the arms 33' and thereby raise the hopper 13'. After the hopper is overturned to empty its contents into storage body 23', it can be returned to its normal position in front of the vehicle 11'. In this type of vehicle 11', the particularly dangerous area is typically that beneath the hopper 13'. A person 21 standing within this area during the loading operation can be severely injured when the hopper 13' is lowered into its normal position.

In this second type of vehicle 11', a pair of housings 81' and 83' can be mounted on typically stationery arms 113 which extend from the front of the vehicle 11' on either side of the hopper 13'. In an embodiment including the photoelectric system, the movement of a person 21' across the plane 85' will actuate the detection means 43' and thereby inhibit operation of the loading apparatus.

Figure 10:
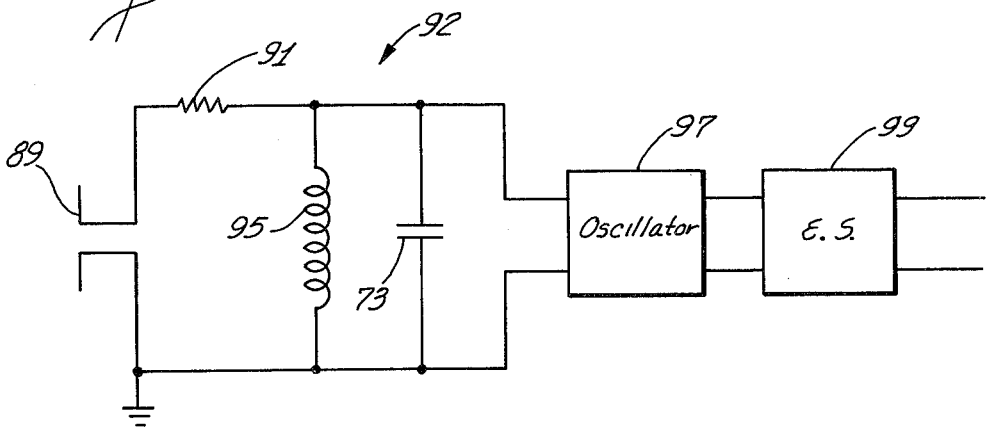
FIG. 10 is a schematic diagram of an additional embodiment of the personnel detection means of the present invention.

The transducers 103 and 105 of the detection apparatus illustrated in FIG. 11 could also be mounted in the respective housings 81' and 83'. The antenna or probe 89' of the detection apparatus illustrated in FIG. 10 would typically be mounted on the front of the vehicle 11'.

In accordance with these preferred embodiments and other embodiments which may be within the scope of the invention, any vehicle can be provided with means for detecting the presence of a person 21 in a particular area and for inhibiting the operation of apparatus which makes the particular area dangerous to the personnel. As noted, the loading apparatus of both the first and second types of refuse collection vehicles 11 can be inhibited when a person 21 moves into proximity to the hopper 13. The personnel detection means 43 may include a sender and a receiver interconnected by a detection signal, such as light rays or sound waves, which extends across the particular area. Alternatively, the personnel detection means may include an antenna which detunes a tank circuit when a person moves into the dangerous area. These types of detection means provide an electrical output signal which can be used to inhibit the operation of a motor or a hydraulic valve associated with the loading apparatus.

I claim:

1. A vehicle for collecting refuse having a storage body and a hopper into which personnel associated with the vehicle initially dump the refuse, the vehicle further comprising:

displacement means for displacing the refuse from the hopper into the storage body, the displacement means being movable in a particular direction relative to the storage body to make a particular area in proximity to the vehicle dangerous to the personnel;

power means for moving the displacing means in the particular direction to displace the refuse from the hopper into the storage body;

transmission means disposed relative to the particular area for transmitting a signal across the particular area;

detection means disposed relative to the transmission means in a position to receive directly the transmitted signal, the detection means having characteristics for providing a particular electrical signal when the transmitted signal is not received by the detection means;

the power means being responsive to the particular electrical signal provided by the detection means to inhibit movement of the displacement means in the particular direction; whereby the presence of the personnel in the particular area blocks the transmitted signal so that the detection means provides the particular signal to inhibit movement of the displacement means by the power means.

2. The vehicle recited in claim 1 wherein the transmitting means provides sound waves and the receiving means is responsive to the characteristics of the sound waves to provide the output signal.

3. The combination recited in claim 2 further comprising:

an oscillator included in the transmitting means and providing the detection signal with a particular carrier frequency; wherein a person present in the particular area modulates the carrier frequency of the sound waves; and modulation detection means included in the receiving means and responsive to the modulation of the particular carrier frequency to provide the electrical output signal.

4. The combination recited in claim 1 wherein the personnel detection means includes:

an oscillator providing an intermediate signal normally having a particular amplitude;

a tank circuit for controlling the frequency of the oscillator;

an antenna connected to provide a shunt across the tank circuit and responsive to the presence of a person in the particular area to change the Q of the tank circuit;

the oscillator responsive to the change in the Q of the tank circuit to provide the intermediate signal with an amplitude greater than the particular amplitude; and means responsive to the increased amplitude of the oscillator to provide the electrical output signal.

5. The vehicle recited in claim 1 wherein the displacement means comprises:

a structural member movable in the first direction to displace the refuse from the hopper into the storage body;

pump means responsive to the operation of the motor to provide a source of high-pressure fluid;

a hydraulic cylinder connected between the structural member and the pump means and having a first cavity for receiving the high-pressure fluid to move the structural member in the first direction;

valve means connected to the pump means and the hydraulic cylinder, the valve means including a gate movable to at least a first position to introduce the high-pressure fluid into the first cavity of the hydraulic cylinder;

the valve means being responsive to the particular electrical signal of the detection means to inhibit the gate from moving to the first position and thereby inhibit movement of the structural member in the first direction.

6. The vehicle recited in claim 5 wherein:

the structural member is movable in a second direction to reduce the danger to personnel in the particular area;

the hydraulic cylinder includes a second cavity for receiving the high-pressure fluid to move the structural member in the second direction; and the gate of the valve means is movable to a second position to introduce the high-pressure fluid to the second cavity of the hydraulic cylinder to reduce the danger to personnel in the particular area.

7. The vehicle recited in claim 1 wherein the detecting means comprises:

the transmission means having a fixed relationship with the vehicle and having properties for sending a detection signal relative to the particular area;

the detection means having a fixed relationship with the vehicle and positioned with respect to the transmitting means to receive the detection signal, the detection means being responsive to particular characteristics of the detection signal as represented by a disposition of a person in the particular area to provide the output signal; whereby a person disposed in the particular area provides the detection signal with the particular characteristics so that the first means inhibits the particular function.

8. The vehicle recited in claim 7 wherein the transmitting means provides sound waves and the receiving means is responsive to the characteristics of the sound waves to provide the output signal.

9. The vehicle set forth in claim 1 wherein the power means includes:

a source of electric current;

motor means connected to the displacement means and being responsive to the electric current from the source to move the displacement means in the particular direction;

means for introducing the electric current from the source to the motor means, the introducing means including a pair of contacts; and means included in the introducing means for normally connecting the contacts in the introducing means to facilitate introduction of the electric current to the motor means, the connecting means being responsive to the particular signal to disconnect the contacts and thereby inhibit movement of the displacement means in the particular direction.

10. The vehicle recited in claim 1 wherein the transmission means is mounted in fixed relationship to the storage body on one side of the particular area and the detection means is mounted in a fixed relationship to the storage body on a side of the particular area opposite to the transmission means in the path of the transmitted signal.

11. The vehicle recited in claim 1 wherein the hopper is disposed in a fixed relationship to the storage body at the rear of the vehicle and the displacement means includes a packing panel movable relative to the hopper to render the particular area dangerous to the personnel, the transmission means and the detection means being attached to the hopper in fixed relationship to the storage body.

12. The vehicle set forth in claim 1 wherein the hopper is disposed at the front of the vehicle and the displacement means includes loading arms movable relative to the storage body to elevate the hopper above the storage body, the transmission means and detection means being mounted to extend at the front of the vehicle in fixed relationship to the storage body.

13. A vehicle for collecting refuse, including:

a storage body;

a hopper positioned with respect to the storage body to initially receive the refuse to be collected;

loading apparatus disposed relative to the storage body for displacing refuse from the hopper into the storage body, the loading apparatus being operable to move in a first direction relative to the storage body to render a particular area in proximity to the vehicle dangerous to personnel;

means connected to the loading apparatus for controlling the movement of the loading apparatus relative to the storage body;

means for detecting the presence of a person in the particular area at least during movement of the loading apparatus in the first direction and for providing a particular signal when a person is detected in the particular area; and the controlling means being responsive to the particular signal provided by the personnel detection means to inhibit movement of the loading means in the first direction when a person is present in the particular area.

14. The vehicle set forth in claim 13 wherein the hopper is disclosed in the front of the vehicle and the loading apparatus includes a pair of loading arms each pivotally mounted with respect to the storage body and attached to the hopper, the loading arms being operable by the controlling means to elevate the hopper to a position above the storage body to facilitate dumping of the refuse from the hopper into the storage body.

15. The vehicle set forth in claim 14 wherein the detecting means includes:

at least one light source providing at least one beam of light;

at least one photoelectric cell positioned relative to the light source to receive the beam of light and provide an electrical output signal when the beam of light is interrupted.

16. The vehicle set forth in claim 15 further comprising reflection means disposed in the path of at least one of the beams of light to provide an additional beam of light extending relative to the particular area.

17. The vehicle set forth in claim 16 wherein the beams of light define a plane extending relative to the particular area.

18. The vehicle recited in claim 16 wherein the beams of light intersect.

19. The vehicle set forth in claim 14 wherein the moving means comprises:

a motor operable to move the loading apparatus and thereby displace the refuse from the hopper to the storage body;

a battery;

means connecting the battery and the motor in an electrical circuit to energize the motor and thereby move the loading apparatus;

the electrical circuit being interrupted to provide a pair of terminals;

first switching means normally connecting the terminals to facilitate the energizing of the motor, the first switching means being responsive to the output signal of the detecting means to inhibit the energizing of the motor.

20. The vehicle recited in claim 19 further comprising:

second switching means for overriding the first switching means to energize the motor when the detecting means is providing the output signal.

21. The vehicle recited in claim 13 wherein the detecting means comprises:

an oscillator providing an intermediate signal normally having a particular amplitude;

a tank circuit for controlling the frequency of the oscillator;

an antenna connected to provide a shunt across the tank circuit and responsive to the presence of a person in the particular area to change the Q of the tank circuit;

the oscillator responsive to the change in the Q of the tank circuit to provide the intermediate signal with an amplitude greater than the particular amplitude; and means responsive to the increased amplitude of the oscillator to provide the electrical output signal.

* * * * *